US011554473B2

(12) United States Patent
Resch

(10) Patent No.: US 11,554,473 B2
(45) Date of Patent: Jan. 17, 2023

(54) LOWERING MECHANISM FOR HAND HELD JACKING TOOL

(71) Applicant: VIKING ARM AS, Oslo (NO)

(72) Inventor: Øyvind Resch, Oslo (NO)

(73) Assignee: VIKING ARM AS, Oslo (NO)

( * ) Notice: Subject to any disclaimer, the term of this patent is extended or adjusted under 35 U.S.C. 154(b) by 0 days.

(21) Appl. No.: 17/602,485

(22) PCT Filed: Apr. 8, 2020

(86) PCT No.: PCT/NO2020/050100
§ 371 (c)(1),
(2) Date: Oct. 8, 2021

(87) PCT Pub. No.: WO2020/209731
PCT Pub. Date: Oct. 15, 2020

(65) Prior Publication Data

US 2022/0203511 A1 Jun. 30, 2022

(30) Foreign Application Priority Data

Apr. 12, 2019 (NO) ..... 20190508

(51) Int. Cl.
*B25F 1/00* (2006.01)
*B66F 1/02* (2006.01)
(Continued)

(52) U.S. Cl.
CPC ..... *B25F 1/00* (2013.01); *B05C 17/0052* (2013.01); *B05C 17/0123* (2013.01); *B66F 1/02* (2013.01); *B66F 2700/025* (2013.01)

(58) Field of Classification Search
CPC ... B25F 1/00; B05C 17/0052; B05C 17/0123; B66F 1/00; B66F 1/02; B66F 2700/02;
(Continued)

(56) References Cited

U.S. PATENT DOCUMENTS 2,820,608 A 1/1958 Braselmann
3,064,945 A * 11/1962 Forbes ..... B66F 1/02 248/354.1
(Continued)

FOREIGN PATENT DOCUMENTS

DE 2 002 246 A 7/1971
GB 501554 A 3/1939
(Continued)

OTHER PUBLICATIONS

International Search Report and Written Opinion in International Application PCT/NO2020/050100, dated Jun. 24, 2020.
(Continued)

*Primary Examiner* — Tyrone V Hall, Jr.
*Assistant Examiner* — Sukwoo James Chang
(74) *Attorney, Agent, or Firm* — Leydig Voit & Mayer, Ltd.

(57) ABSTRACT

A lowering mechanism for a hand held jacking tool comprises a caulking gun jacking mechanism. The lowering mechanism comprises a lowering plate on top of the holding plate, a pushing lever connected with a hinge attachment to the lowering plate at a rear end, wherein the pushing lever is pivoting around a pivot structure connected to the lever or holding plate a distance backward from the hinge attachment, causing the lowering plate to grip the jacking shaft when the lever is pushed downwards and then, in turn, pushing the holding plate downwards and loosening it from the jacking shaft and moving it down along the jacking shaft a distance determined by the pivoting action of the lever. The lowering plate is held in place by a spring biasing the lowering plate towards the holding plate.

7 Claims, 4 Drawing Sheets

(51) Int. Cl.
*B05C 17/005* (2006.01)
*B05C 17/01* (2006.01)

(58) Field of Classification Search
CPC ..... B66F 2700/025; B66F 13/00; B25B 27/0035; B25B 27/02; B25B 27/0233; B25B 5/102; B60T 17/221; F16D 65/0043; Y10T 29/53648; Y10T 29/53683; Y10T 29/53796; Y10T 29/53848; Y10T 29/53891
See application file for complete search history.

(56) References Cited

U.S. PATENT DOCUMENTS 4,009,804 A 3/1977 Costa et al.
4,084,792 A * 4/1978 Baron ..... B66F 1/02 254/106

FOREIGN PATENT DOCUMENTS

GB 732528 A 6/1955
JP H2-105993 U 8/1990

OTHER PUBLICATIONS

International Preliminary Report on Patentability in International Application PCT/NO2020/050100, dated Jul. 4, 2021.

* cited by examiner

LOWERING MECHANISM FOR HAND HELD JACKING TOOL

CROSS-REFERENCE TO RELATED APPLICATIONS

This patent application is the U.S. National Stage of International Patent Application No. PCT/NO2020/050100, filed Apr. 8, 2020, which claims the benefit of Norwegian Patent Application No. 20190508, filed Apr. 12, 2019, which are each incorporated by reference.

FIELD OF INVENTION

The invention relates to a hand held jacking mechanism, more specifically to a lowering mechanism for a hand held tool for jacking and levelling of objects using a caulking gun jacking mechanism.

BACKGROUND OF THE INVENTION

A caulking gun is well known in the tool industry and has been on the market for several decades. They include a pumping or jacking mechanism for example described in U.S. Pat. No. 4,009,804. This mechanism is cheap and easy to produce and has minimal friction under operation.

The inventor has invented a hand held tool for jacking and levelling of objects using a caulking gun jacking mechanism. The caulking gun jacking mechanism is a one way jacking system. It is possible to jack a frame with such a jacking mechanism upwards along a jacking shaft. When the frame is released it is 'falling' uncontrollably along the jacking shaft. This invention will control the downward movement of the frame along the jacking shaft in a caulking gun jacking mechanism in an adjustable stepwise manner.

BRIEF SUMMARY OF THE INVENTION

The invention describes a lowering mechanism for a hand held jacking tool comprising a jacking frame a jacking shaft and a caulking gun jacking mechanism comprising at least one jacking plate biased towards an open state and at least one holding plate, above the jacking plate, being biased towards a gripping state. The lowering mechanism comprises a lowering plate on top of the holding plate being parallel to the holding plate when not activated. The lowering mechanism further comprises a pushing lever, a hinge attachment connecting the pushing lever to the lowering plate at a rear end towards an operating handle and a pivot structure connected to the pushing lever or holding plate a distance backward from the hinge attachment. The lowering mechanism further comprise a spring biasing the lowering plate towards the holding plate. The lowering plate is lifted up and grips the jacking shaft when the pushing lever is pushed downwards and pivots around the pivot structure and in turn pushes the holding plate downwards loosening it from the jacking shaft and moving the frame down along the jacking shaft a distance until the holding plate reaches an angle that stops it against the jacking shaft while the lowering plate still grips the jacking shaft.

BRIEF DESCRIPTION OF THE SEVERAL VIEWS OF THE DRAWINGS

To improve the understanding of the application the following drawings have been supplied. Like numerals in different drawings represent the same features.

DETAILED DESCRIPTION OF PREFERRED EMBODIMENTS

Figure 1:
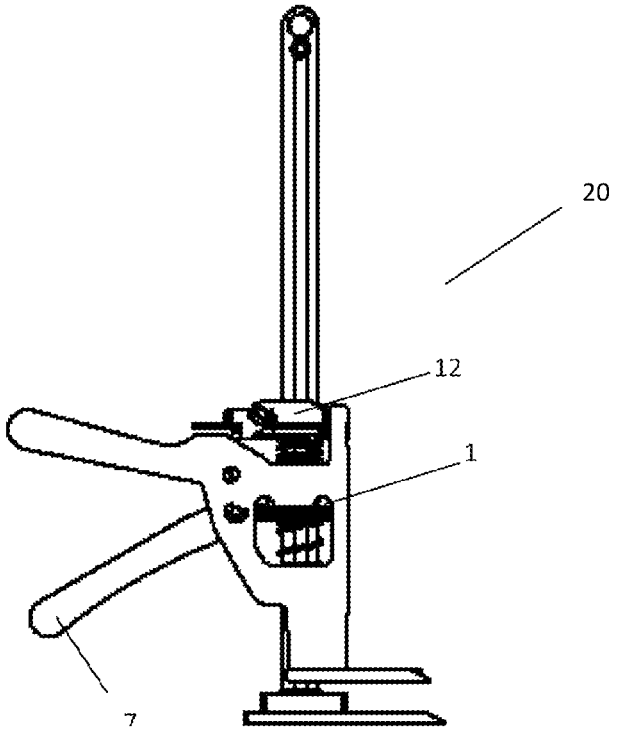
FIG. 1 shows the entire hand held tool.

We will describe the invention with directions up-down as seen in FIG. 1 and rear as pointing towards the user. The rear is the side of the operating handle 7, as seen in FIG. 1, and the front is the opposite side, or, in other words, the direction in which the feet are pointing.

Figure 2:
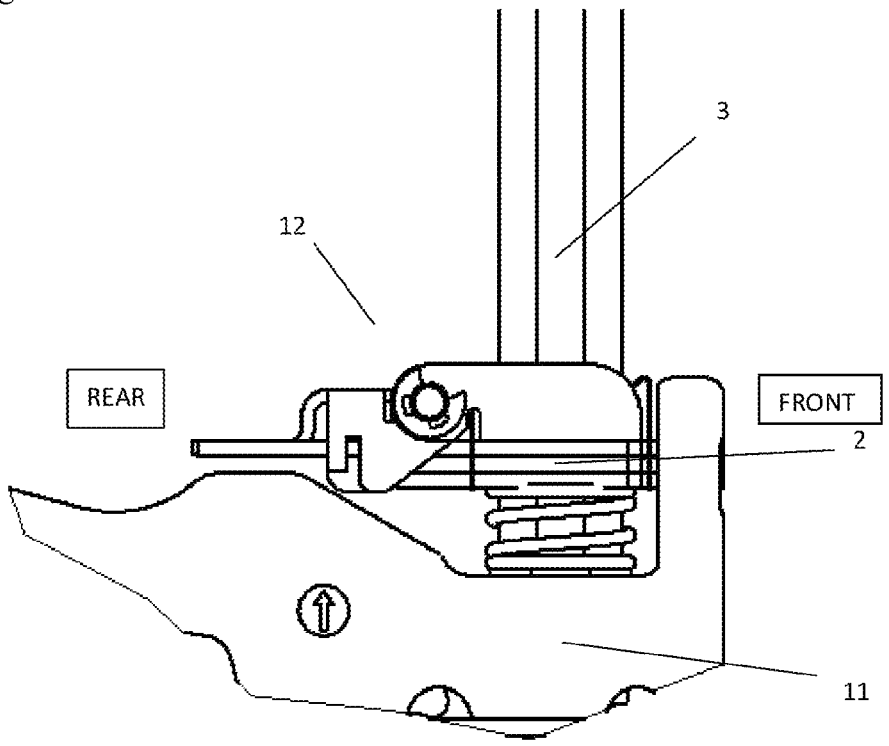
FIG. 2 shows the frame of the tool with the lowering mechanism.
Figure 9A:
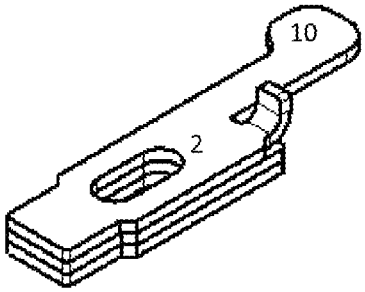
FIGS. 9*a* and b shows three holding plates in perspective view and from the side respectively.
Figure 9B:
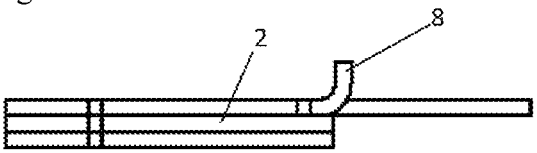

The invention describes a lowering mechanism 12 for a hand held jacking tool 20 comprising a jacking frame 11 a jacking shaft 3 and a caulking gun jacking mechanism. The jacking mechanism normally comprises a jacking plate 1 biased towards an open state and a holding plate 2 above the jacking plate I being biased towards a locked state as can be seen in FIGS. 1 and 2. The plates are moveable along a jacking shaft 3 and are able to grip the jacking shaft 3. It may be an advantage to have more than one plate, for example two or three parallel plates as seen in FIGS. 9*a* and *b*. This will reduce the wear on jacking shaft and plates and prolong the life of the mechanism, it will also provide a better grip as contact will be made on several contact regions. To obtain this effect the holes must have same size.

The plates 1, 2, moving along the jacking shaft in a caulking gun jacking mechanism, comprises holes slightly bigger than the cross section of the jacking shaft. When the plates are at a right angle with the jacking shaft the plates are moving freely along the shaft. When the plates are not at a right angle with the jacking shaft the plates will grip and lock to the jacking shaft. This is the main principle in a caulking gun jacking mechanism. In this text we call the two states the open state (right angle) and the gripping state (not a right angle). When we describe the different plates 1, 2, 4 in this text we will automatically assume that a suitable hole, as shown in FIG. 9*a*, to fit the jacking shaft is provided.

Figure 7A:
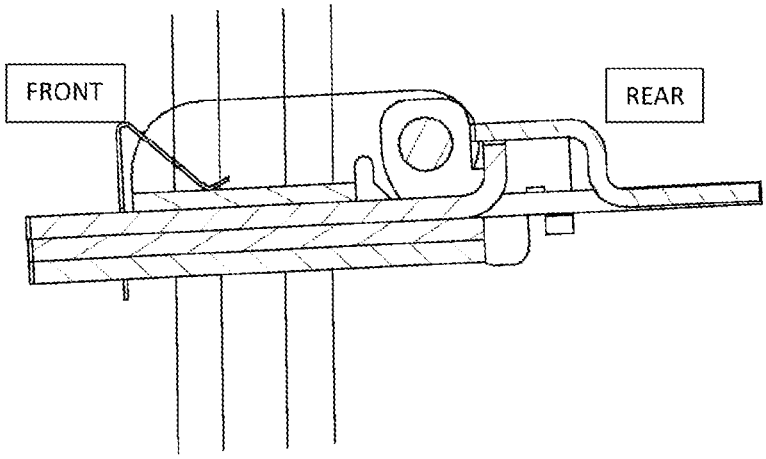
FIGS. 7*a, b* and *c* shows activation of the lowering mechanism.

The lowering mechanism according to the invention comprises a lowering plate 4 on top of the holding plate 2 being in the same gripping state as the holding plate when not activated. This corresponds to the lowering plate being parallel with the holding plate. The lowering mechanism will then be in the position as seen in FIG. 7*a*.

Figure 7B:
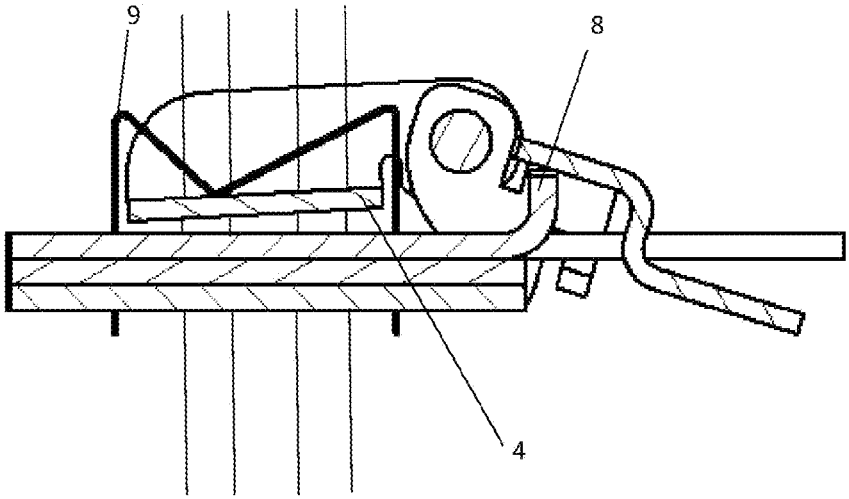
Figure 7C:
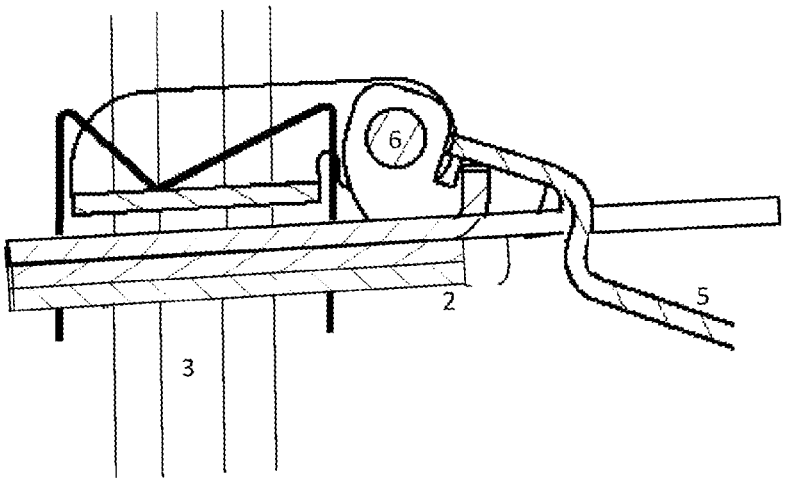

The lowering plate is activated by a pushing lever 5 connected with a hinge attachment 6 to the lowering plate at a rear end towards an operating handle 7, wherein the pushing lever is pivoting around a pivot structure 8 connected to the lever or holding plate a distance backward from the hinge attachment, causing the lowering plate 4 to grip the jacking shaft 3 when the lever is pushed downwards. When the lowering plate grips the jacking shaft a further push on the lever 5, by the operator, will push the holding plate downwards and loosen it from the jacking shaft as seen in FIG. 7*b*. This will allow the frame to move downward along the jacking shaft a distance until the holding plate reaches an angle that stops it against the jacking shaft 3 while the lowering plate still grips the shaft. This leaves the lowering plate and the holding plate with a distance between them. If the holes for the jacking shaft in the lowering plate and the holding plate have the same size the two plates will also be mainly parallel as seen in FIG. 7*c*. The frame has moved down along the jacking shaft a distance determined by the pivoting action of the lever while the lowering plate 4 is stopping the frame from further downward movement. The distance the frame is moving is fairly similar to the distance between the parallel lowering plate and holding plate seen in FIG. 7*c*. This corresponds to the vertical component of the angular movement of the arm between the hinge attachment 6 and the pivot structure 8 from the position where the pushing lever 5 causes the lowering plate to grip the jacking shaft. When the pushing lever 5 is released the spring 9 forces the lowering plate down towards the holding plate and the lowering mechanism is back to the position seen in FIG. 7*a*.

Figure 5:
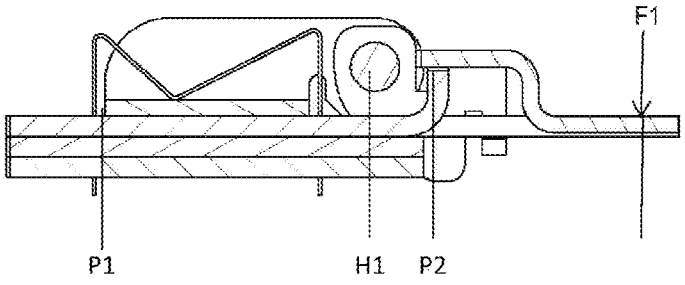
FIG. 5 shows a sectional side view of an embodiment of the lowering mechanism with an M-shaped spring.

The pivoting action of the lever 5 is determined by a first pivot point, P1, at the front end of the lowering plate, as seen in FIG. 5, the hinge attachment 6, H1, and a second pivot point, P2, associated with the pivot structure 8 and finally the force applied to the lever and the length of the lever arm. This is shown in FIG. 5. The positional distribution of P1, P2, H1 and F1 are hard to calculate and have to be tested and tried. If the distance H1-P2 is to big related to the distance P1-H1 and P2-F1 the mechanism will simply release the frame as with the old version. If the distance H1-P2 is too small related to the distance P1-H1 and P2-F1 the lowering mechanism 12 will not be activated. However, the length of arms and position of pivot points must be such that an activation force used on the pushing lever 5 to cause the lowering plate 4 to grip the jacking shaft 3 must be less than the force needed to release the holding plate 2. The activation force must also counter the force of the spring 9 holding the lowering plate down. Therefor the length of the pushing lever rearward of the pivoting point 8 must be longer than the distance between the pivot point 8 and the hinge attachment 6, preferably more than twice the distance.

Figure 3:
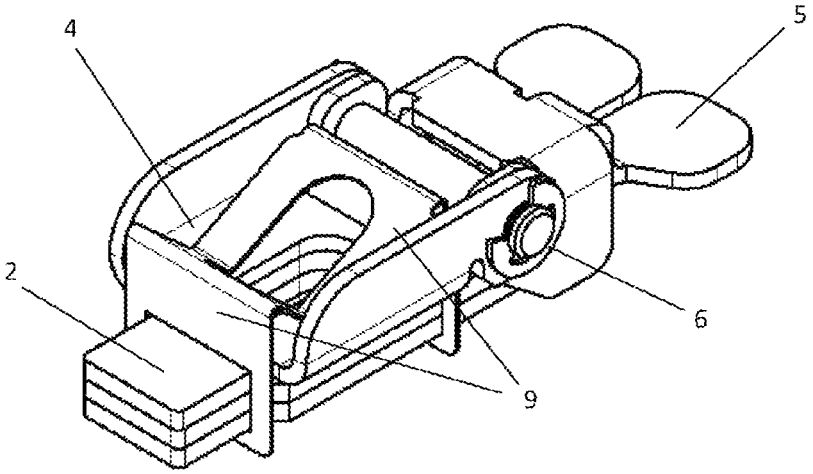
FIGS. 3 and 4 show perspective views of an embodiment of the lowering mechanism on top of the holding plates.
Figure 4:
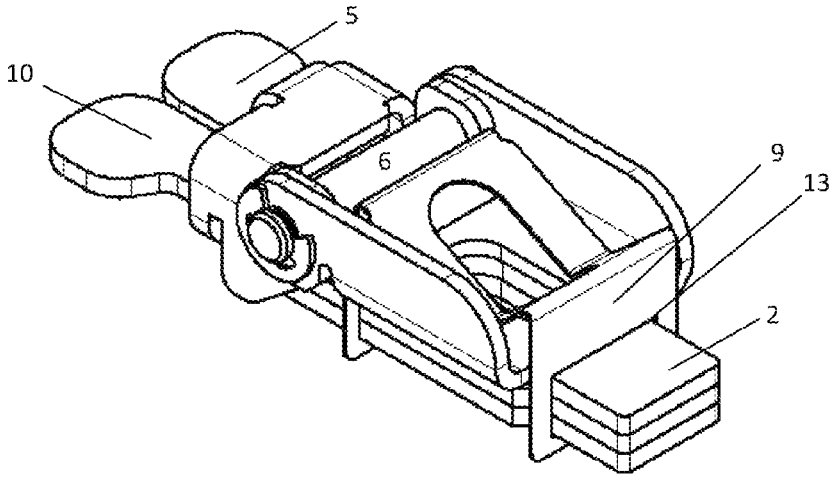
Figure 6:
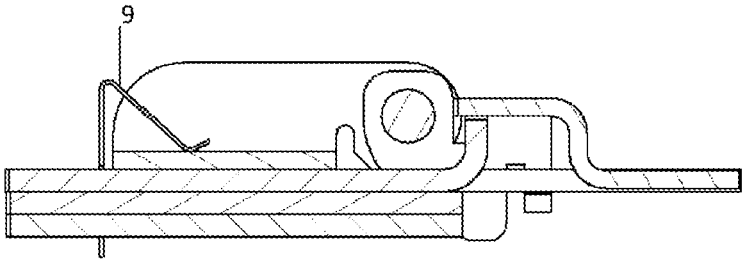
FIG. 6 shows a sectional side view of an embodiment of the lowering mechanism with 15 a spring shaped like a half M.
Figure 8:
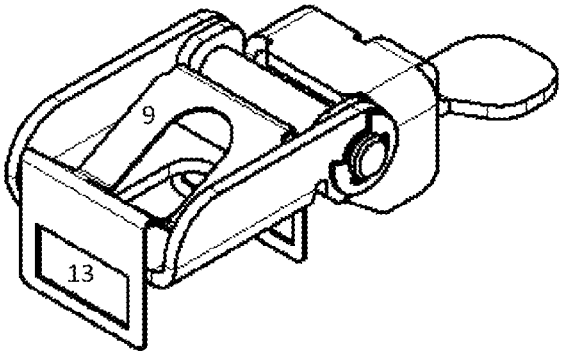
FIG. 8 shows a lowering plate with a M-shaped spring.

The lowering plate is held in place by a spring 9 biasing at least the front side of the lowering plate towards the holding plate. Two embodiments of the spring are shown in FIGS. 5 and 6. One is a M-shaped spring plate and the other is a spring plate, which is shaped as a half M. Advantageously the spring is held in place by a holding structure 13, as shown in FIG. 8, through which the holding plate (s) will fit as shown in FIGS. 3 and 4 and in particular FIG. 8, thus holding the spring to the holding plate(s). In one embodiment the spring is an M-shaped spring plate 9 with a hole for the jacking shaft and holes for the holding plate(s) in the respective legs of the M-shaped spring plate on each side of the jacking shaft.

The lowering mechanism is not very sensitive to the strength and positioning of the spring 9, whose main purpose is to push the lowering plate back down towards the holding plate. However, we found that it was best to avoid positioning a center of force too close to the hinge attachment 6. Preferably the center of force is positioned in front of the center of the lowering plate as seen in the figures.

The lowering mechanism is sensitive to the gap between the front and rear sides of the jacking shaft and the holes in the holding and lowering plates 2, 4. This distance should be less than a millimeter. Preferably between 0.02 and 0.03 mm. Larger shafts allow for larger gap. If the gap is too big the grip of the holding plate will weaken and if it is too small, it will tend to jam.

In one embodiment the rear end of the pushing lever and a release lever 10, which is an extension of the holding plate 2, is positioned beside each other for easy operation by the thumb of an operator as seen in FIG. 3, 4.

In one embodiment the pivot structure 8 is moveable in the rear-front direction and/or in the up-down direction to regulate the distance of the downward movement and/or compensate for wear and tear of the jacking shaft and/or holding plate.

The invention claimed is:

1. A lowering mechanism for a hand held jacking tool comprising a jacking frame, a jacking shaft, and a caulking gun jacking mechanism comprising at least one jacking plate biased towards an open state and at least one holding plate, above the at least one jacking plate, being biased towards a gripping state, wherein the lowering mechanism comprises:

a lowering plate on top of the at least one holding plate being parallel to the at least one holding plate when not activated, a spring biasing the lowering plate towards the at least one holding plate, a thumb operable pushing lever, a release lever which is an extension of the at least one holding plate, a hinge attachment connecting the thumb operable pushing lever to the lowering plate at a rear end towards an operating handle, a pivot structure connected to the thumb operable pushing lever or the at least one holding plate a distance backward from the hinge attachment, wherein the lowering plate is lifted up and grips the jacking shaft when the thumb operable pushing lever is pushed downwards and pivots around the pivot structure and in turn, pushes the at least one holding plate downwards loosening the at least one holding plate from the jacking shaft and moving the jacking frame down along the jacking shaft a distance until the at least one holding plate reaches an angle that stops the at least one holding plate against the jacking shaft while the lowering plate still grips the jacking shaft.

2. The lowering mechanism according to claim 1, wherein the rear end of the thumb operable pushing lever and the release lever are positioned beside each other.

3. The lowering mechanism according to claim 1, wherein the pivot structure is moveable in a rear-front direction and/or in an up-down direction to regulate the distance of the downward movement of the jacking frame.

4. The lowering mechanism according to claim 1, wherein the spring is an M-shaped spring plate with a hole for the jacking shaft and a holding structure in respective legs of the M-shape on each side of the jacking shaft for holding the spring to the at least one holding plate.

5. The lowering mechanism according to claim 4, wherein the holding structure is a hole through which the at least one holding plate will fit.

6. The lowering mechanism according to claim 1, wherein the spring is a spring plate shaped as a half M with a holding structure in a leg of the half M for holding the spring to the at least one holding plate.

7. The lowering mechanism according to claim 6, wherein the holding structure is a hole through which the at least one holding plate will fit.

* * * * *